United States Patent [19]

Schenk

[11] 4,341,252

[45] Jul. 27, 1982

[54] DECORATIVE CANOPY MEANS FOR TOILET TISSUE ROLL MOUNTING

[76] Inventor: Doris Schenk, 4732 E. Pleasant Run Pkwy., N. Dr., Indianapolis, Ind. 46201

[21] Appl. No.: 288,891

[22] Filed: Jul. 31, 1981

[51] Int. Cl.[3] ..... E04F 10/00

[52] U.S. Cl. ..... 160/45; 160/19; 160/83 R; 160/352

[58] Field of Search ..... 160/19–22, 160/45, 50, 56, 76, 83, 88, 89, 127–129, 327, 387, 388, 352; 248/253, 255, 261–265, 345

[56] References Cited

U.S. PATENT DOCUMENTS 977,565 12/1910 Smith ..... 160/83 R

*Primary Examiner*—Peter M. Caun

*Attorney, Agent, or Firm*—Robert A. Spray

[57] ABSTRACT

An attractive canopy means, for covering a toilet tissue roll mounting, including a flexible skirt-like panel supported by upper and lower support members each of a general C-shape, and being movable for easy access to the roll of toilet tissue and for replacing such a roll.

11 Claims, 3 Drawing Figures

DECORATIVE CANOPY MEANS FOR TOILET TISSUE ROLL MOUNTING

The present invention relates to a canopy means, as for providing a decorative and attractive cover or housing for an installation of a roll of toilet tissue on an associated wall or support means.

The concepts provide that the canopy means is of economical construction, having an upper support member, of a generally C-shape, whose end portions are supportingly connectable to the associated support wall, and a lower support or body member means, also of a generally C-shape.

Both the C-shaped support means are supportingly connected to a skirt-like enclosure panel means, by passing through hems provided in the panel means, securely but movably supporting the panel means but assuring a tautness thereof for attractiveness as a decorative roof-like canopy.

The upper of the C-shaped support members is releasably connected to supporting bracket means connected to the wall, but the lower of the C-shaped members is held in a generally horizontal plane by the hem of the panel means, thus providing that the lower C-shaped support member holds the flexible sheeting of the panel means taut but permits the panel body to be raised conveniently without requiring any release of anything when it is desired to change a tissue roll, and avoids any need of any installation of a wall-connected support for the lower of the C-shaped support members.

The above has been of rather introductory nature. More particular details, concepts, features, and advantages of the present invention are set forth in the more detailed description which follows, reference being had to the accompanying somewhat schematic drawings, in which.

Figure 1:
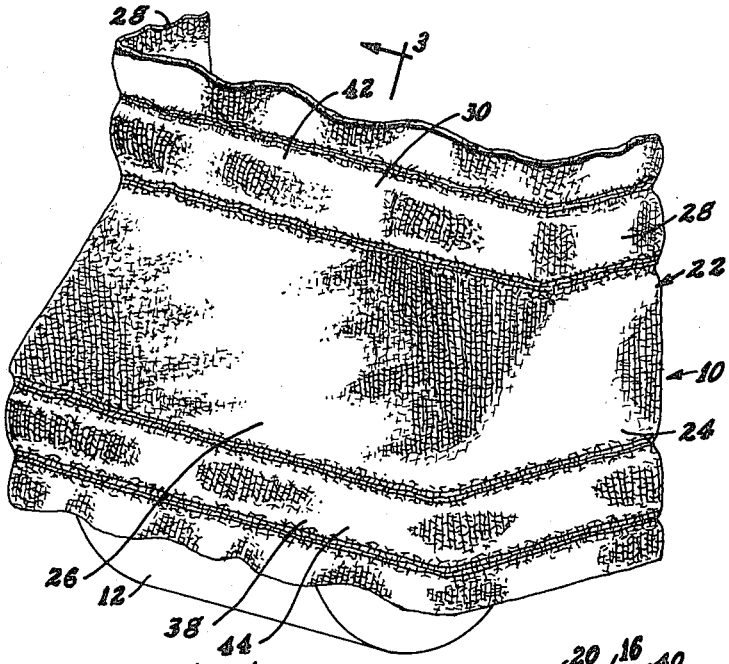
FIG. 1 is a pictorial view of a canopy means according to the present inventive concepts, in an installation providing a cover for a roll of toilet tissue.
Figure 2:
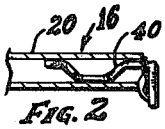
FIG. 2 is a fragmental cross-sectional view taken generally as indicated by view line 2—2 of FIG. 3.
Figure 3:
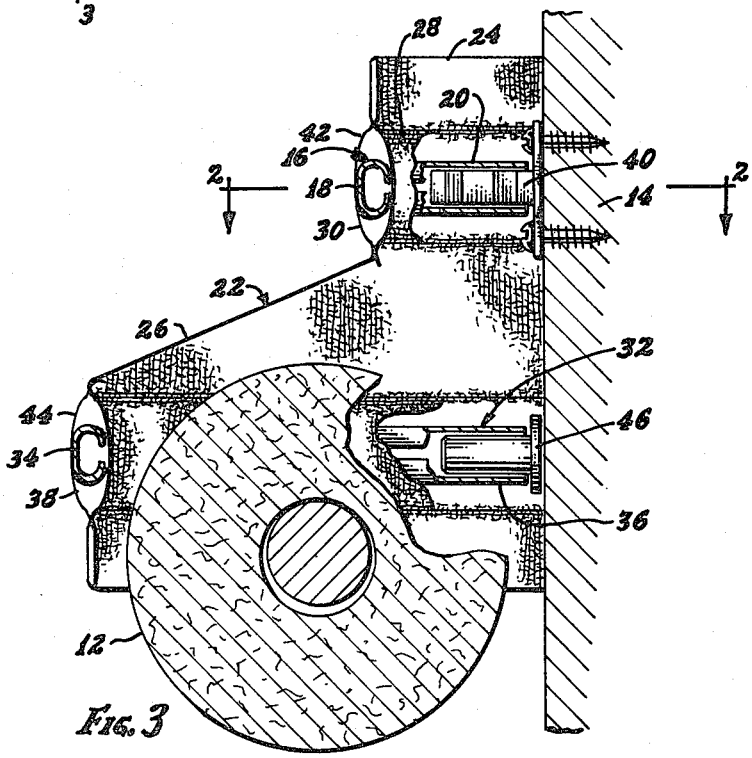
FIG. 3 is a cross-sectional view through a canopy installation as shown in FIG. 1, mounted on an associated supporting wall, this view being generally as indicated view line 3—3 of FIG. 1.

As shown in the drawings, the present inventive concepts provide a canopy means 10, as for providing an advantageous and decorative cover or housing, particularly for an installation of a roll 12 of toilet tissue on an associated wall or support means 14.

The canopy means 10 as shown is of economical construction, yet is attractive and long-lasting, and does not interfere with conventional use of the paper roll.

The upper portion of the canopy means 10 is shown as having an upper support member 16, which is of a generally C-shape; and it has an intermediate span 18 and opposed end portions 20 which extend generally perpendicularly with respect to the intermediate span 18.

The end portions 20 of the upper support member 16 are supportingly but releasably connectable to the associated wall or support means 14, providing support of the canopy 10.

The most prominently visible of the canopy's components is an enclosure panel means 12. It has end panel portions 24 and an intermediate panel portion 26; and the upper portions 28, 30 of the panel means 22 are respectively supportingly associated with each of the end portions 20 and intermediate span 18 of the upper support member 16.

The lower portion of the canopy means 10 is shown as supported by a body member means 32 which is of a generally C-shape. It is shown as a member having an intermediate span 34, with end portions 36 extending from each end of and generally perpendicular to the intermediate span 34.

The body member means 32 is connectable to the lower portion 38 of the enclosure panel means 22; and it provides for the enclosure panel means 22 a double function of some weight, achieving simply by gravity a downward pull on the enclosure panel means 22 for assuring tautness thereof, and it also achieves an interrelated shaping of the panel portions 24, 26 of the enclosure panel means 22.

In the form shown, a pair of mounting bracket means 40 are provided for supporting attachment to the associated support wall 14, each of the pair of brackets 40 being supportingly co-operative with the end portions 20 of the upper support member 16, for providing a supporting connection of the canopy's upper support member 16 to the associated wall or support means 14.

Describably as shown, the canopy's upper support member 16 is provided wholly from an integral or single length of stock of a type whose cross-sectional nature is such which supportingly co-operates with the mounting bracket means 40 achieving the supporting connection with the bracket 40. More particularly, the upper support member 16 is formed of stock whose cross-sectional shape is that of a slender "O" or "C"; and with this shape, when both ends 20 of the support 16 inserted over the mounting bracket means 40, there is achieved a snug and firm supporting connection of the upper support member 16 to the associated wall or support means 14.

The enclosure panel means 22 is shown as supportingly connectable to the upper support member 16 by being provided with an upper hem means 42 or open loops through which the upper support member 16 passes for achieving the supporting interconnection of the panel means 22 and support member 16.

The panel means 22 is provided of flexible sheet material, providing economy and the operativity herein indicated, and preferably of cloth or fabric.

Similarly, the lower portion of the enclosure panel means 22 is supportingly connectable to the body member means 32 by being provided with a lower hem means 44 or open loops through which the body member means 32 passes, for achieving its double function as herein set forth.

Further, the body member means 32 is shown provided with enlarged footpad means 46 for releasably engaging against the associated support wall 14.

One or more of the components are yieldable. That is, the enclosure panel means 22, the interconnection means by which the upper support member 16 is connected to the associated wall or support means 14, and the upper support means 16, is yieldable; and also the engagement of the body member means 32 against the associated support means 14 is releasable. The arrangement thus accommodates an operative raising of the enclosure panel means 22, if and when desired, without any interconnection of any of these components, as may be desired such as to replace the tissue roll 12.

It is thus seen that a canopy means for an installation of a roll of toilet tissue, according to the inventive concepts, provides a desired and advantageous device, yielding the advantages of an attractive and decorative enclosure cover or canopy which is of economical formation, is easy to raise for access to the toilet tissue roll, and yet is quite effective to provide an attractive enclosure panel or canopy for the toilet tissue mounting.

Accordingly, it will thus be seen from the foregoing description of the invention according to this illustrative embodiment, considered with the accompanying drawings, that the present invention provides new and useful concepts of a novel and advantageous canopy means for decoratively and attractively covering an installation of a toilet tissue roll, having desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. A canopy means, as for providing a decorative cover or housing for an installation of a roll of toilet tissue on an associated support means, the canopy means comprising, in combination:

an upper support member, of a generally C-shape, having an intermediate span and end portions extending generally perpendicularly with respect thereto;

the end portions of the upper support member being supportingly connectable to the associated support means;

an enclosure panel means having end panel portions and an intermediate panel portion, the upper portions of which are respectively supportingly associated with each of the upper support member's end portions and intermediate span;

a body member means, of a generally C-shape, having an intermediate span and end portions extending generally perpendicularly thereto; and the body member means being connectable to the lower portion of the enclosure panel means, and providing therefor a double function of some weight achieving a downward pull on the enclosure panel means for assuring tautness thereof and an interrelated shaping of the panel portions of the enclosure panel means.

2. The invention as set forth in claim 1 in a combination in which mounting bracket means are provided for supporting attachment to the associated support means and are supportingly co-operative with the end portions of the upper support member to provide the said supporting connection thereof to the associated support means.

3. The invention as set forth in claim 2 in a combination in which the said upper support member is provided wholly from an integral length of stock whose cross-sectional nature is such as to supportingly cooperate with the said mounting bracket means to achieve the said supporting connection.

4. The invention as set forth in claim 3 in a combination in which the said upper support member is formed of stock whose cross-sectional shape is that of a slender "O" or "C", which when both ends thereof are inserted over the said mounting bracket means, achieves a snug and firm supporting connection of the upper support member to the associated support means.

5. The invention as set forth in claim 1 in a combination in which the enclosure panel means is supportingly connectable to the upper support member by being provided with an upper hem means or open loops through which the said upper support member passes for achieving the supporting interconnection thereof.

6. The invention as set forth in claim 1 in a combination in which the panel means is provided of flexible sheet material.

7. The invention as set forth in claim 1 in a combination in which the panel means is provided of cloth or fabric.

8. The invention as set forth in claim 1 in a combination in which the enclosure panel means is supportingly connectable to the body member means by being provided with a lower hem means or open loops through which the said body member means passes for achieving its double function as herein set forth.

9. The invention as set forth in claim 1 in a combination in which the body member means is provided with enlarged footpad means for engaging the associated support means.

10. The invention as set forth in claim 2 in a combination in which the supporting interconnection of the end portions of the upper support member and the associated mounting bracket is releasable.

11. The invention as set forth in claim 1 in a combination in which one or more of the enclosure panel means, the interconnection means by which the upper support member is connected to the associated support means, and the upper support means, is yieldable, and the engagement of the body member means against the associated support means is releasable, the arrangement thereby accommodating an operative raising of the enclosure panel means, if and when desired, without any interconnection of any thereof.

* * * * *

UNITED STATES PATENT AND TRADEMARK OFFICE

CERTIFICATE OF CORRECTION

PATENT NO. : 4,341,252

DATED : July 27, 1982

INVENTOR(S) : Doris Schenk

It is certified that error appears in the above—identified patent and that said Letters Patent is hereby corrected as shown below:

Col. 1, line 66: Change "12" to: --22--.

Col. 2, line 25: Change "Describably" to: --Desirably--.

Col. 2, line 33: Change "when" to: --with--.

Col. 2, line 57: Before "the" (first occurrence) insert: --one or more of--.

Col. 3, line 13: Before "having" insert: --the canopy means--.

Signed and Sealed this

*Nineteenth* Day of *October 1982*

[SEAL]

*Attest:*

GERALD J. MOSSINGHOFF

*Attesting Officer*

*Commissioner of Patents and Trademarks*